US005238313A

United States Patent [19]

Yamamoto et al.

[11] Patent Number: 5,238,313

[45] Date of Patent: Aug. 24, 1993

[54] DOT MATRIX PRINTER WITH IMPROVED WIRE GUIDE

[75] Inventors: Kazuhiko Yamamoto; Shigeki Mizuno; Hiromi Mimura, all of Suwa, Japan

[73] Assignee: Seiko Epson Corporation, Tokyo, Japan

[21] Appl. No.: 716,040

[22] Filed: Jun. 14, 1991

[30] Foreign Application Priority Data

Jun. 15, 1990 [JP] Japan ..... 2-157049

[51] Int. Cl.[5] ..... B41J 2/265

[52] U.S. Cl. ..... 400/124

[58] Field of Search ..... 400/124, 124 GT; 101/93.05

[56] References Cited

U.S. PATENT DOCUMENTS

| | | | |
|---|---|---|---|
| 3,835,975 | 9/1974 | Howard | 400/124 |
| 4,185,929 | 1/1980 | Hebert | 400/124 GT |
| 4,501,506 | 2/1985 | Weeks et al. | 400/124 GT |
| 4,662,764 | 5/1987 | Cavallari | 400/124 GT |
| 5,048,985 | 9/1991 | Mitsuishi | 400/124 |

FOREIGN PATENT DOCUMENTS

| | | | |
|---|---|---|---|
| 36540 | 9/1981 | European Pat. Off. | 400/124 |
| 170976 | 2/1986 | European Pat. Off. . | |
| 82272 | 7/1981 | Japan | 400/124 GT |
| 286158 | 12/1986 | Japan | 400/124 |

*Primary Examiner*—David A. Wiecking
*Attorney, Agent, or Firm*—Blum Kaplan

[57] ABSTRACT

An impact dot head of a printer provided with a plurality of printing wires. The top end guide and/or the nose formed with protrusions at the sides thereof and with holes for slidably guiding the tips of the printing wires. The top end guide is inserted into a hole and grooves of a nose. The protrusions are then deformed to interlock within the apertures in one of the nose and top end guide, so that the respective end surfaces of the top end guide and the nose surface confronting the printing medium are in a predetermined relation, preferably essentially flush. Further, a method is provided for mass producing the impact dot head at a relatively low cost by using heat to deform the projections made of a thermoplastic resin.

23 Claims, 10 Drawing Sheets

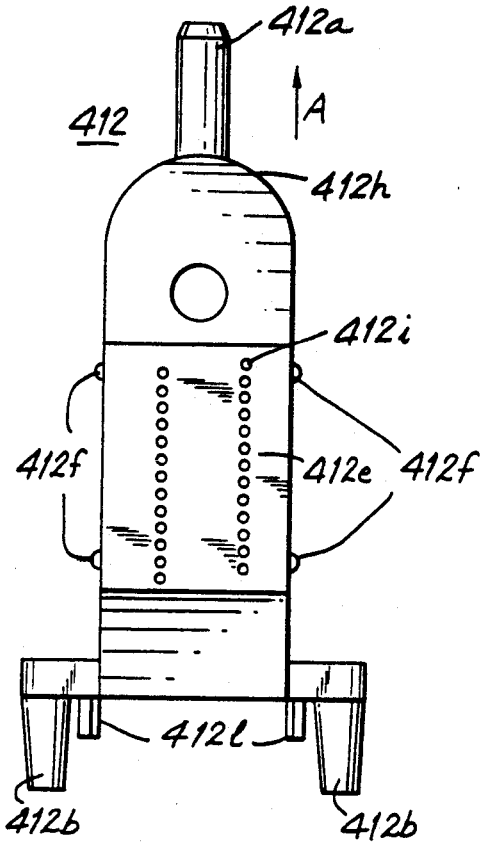
FIG. 6a
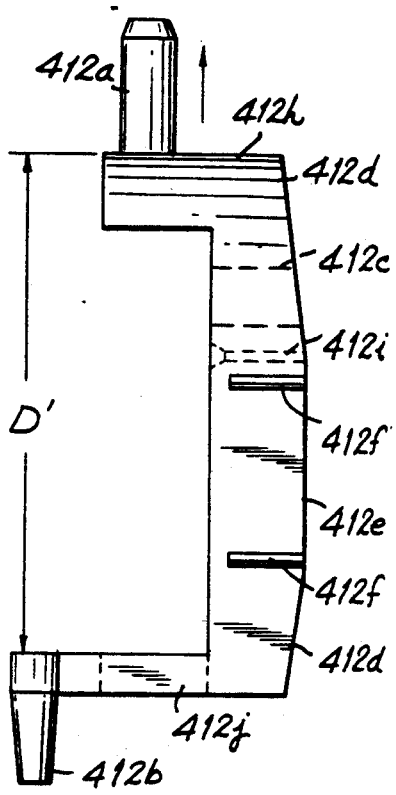
FIG. 6b
FIG. 6c
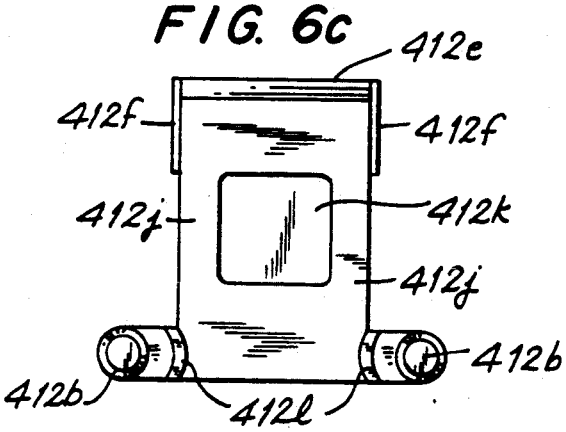

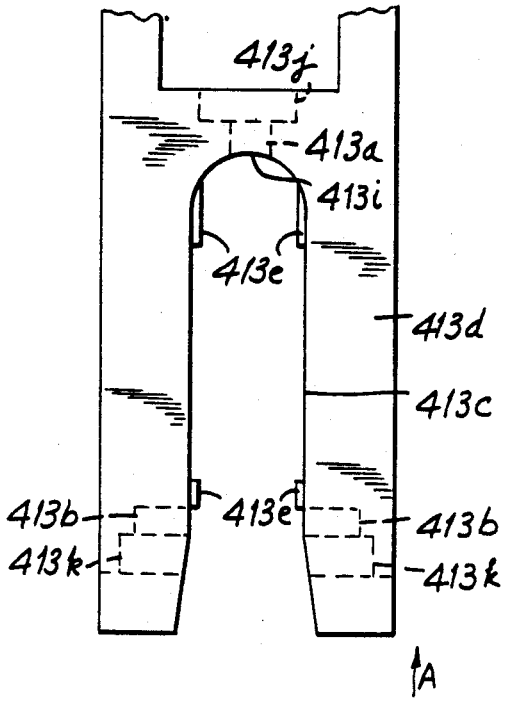
FIG. 7a
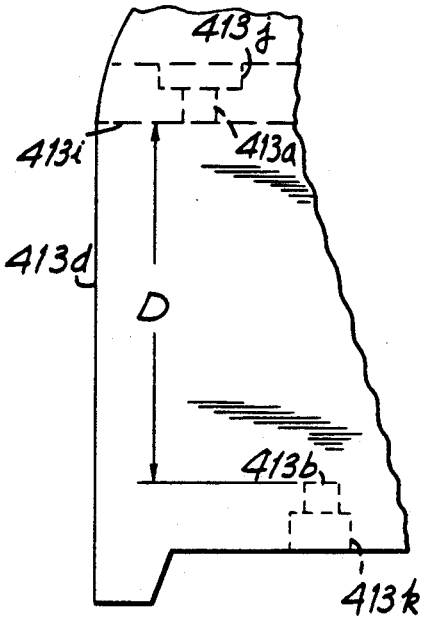
FIG. 7b
FIG. 7c
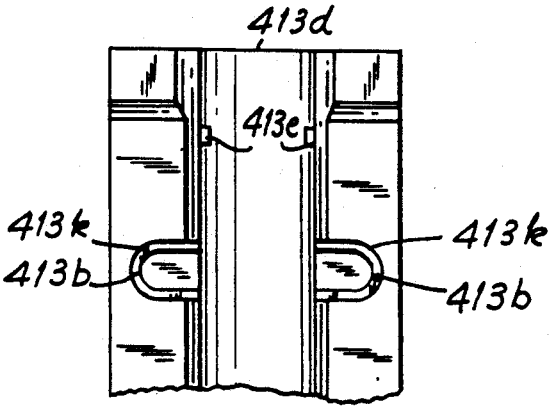

DOT MATRIX PRINTER WITH IMPROVED WIRE GUIDE

BACKGROUND OF THE INVENTION

This invention relates to an impact dot head for an impact dot matrix printer and a method of manufacturing same and, in particular to, an impact dot head having a nose surface flush with a top end guide surface of the impact dot head which can be easily and efficiently manufactured.

Referring to FIG. 1, wherein the prior art impact dot head having a top end guide surface 102*a* facing a printing medium 106 is provided. Top end guide surface 102*a* of a top end guide 102 is recessed in a nose surface 101*a* of a nose 101. In this configuration, when an activated printing wire 105 is caught by a stepped portion 106*a* of a printing medium 106, the projecting length L of printing wire 105 is large between top end guide surface 102*a* and printing medium 106. In this manner, a great amount of stress is applied to a printing wire root 105*a* causing printing wire 105 to be susceptible to breakage. On the other hand, if top end guide surface 102*a* projects from nose surface 101*a*, an ink ribbon 107 is sandwiched between top end guide 102 and a ribbon mask 108.

Consequently, the relationship between the parts of the impact dot head creates a number of problems. For instance, the running or driving property of ink ribbon 107 declines. The feeding capabilities of ink ribbon 107 deteriorate. Abrasion of top end guide 102 is induced due to the friction created by ink ribbon 107. Accordingly, it is desirable for nose surface 101*a* to be flush with top end guide surface 102*a*.

Reference is now made to FIG. 2 which depicts a further conventional impact dot head. In this example, a top end guide 202 and middle guides 203 slidably maintain printing wire 201. Guides 202, 203 are retained by a nose guide 204. In order to make a surface 202*a* of top end guide 202 on the side of a printing medium 207 flush with a surface 205*b* of a nose 205 on the same side, a spacer 206 is interposed between a positioning surface 205*a* of nose 205 and a positioning surface 204*a* of nose guide 204. The thickness of spacer 206 is then adjusted to construct the flush relation between surface 202*a* and surface 205*b*.

FIG. 3 shows another conventional embodiment of an impact dot head. After measuring a thickness t of a top end guide 302, top end guide 302 is then bonded to nose 301 having a stepped portion 301*a* equivalent to the thickness t of top end guide 302. After measuring and bonding, the surfaces of top end guide 302 and nose 301 are flush with each other. Additionally, a machine cut may be made after bonding top end guide 302 to nose 301 to make the surfaces flush with respect to each other.

The conventional impact dot head depicted in FIG. 2 presents a number of problems. The manufacturing process takes an inordinate amount of time to measure a distance D1 from nose surface 205*b* to surface 205*a* and a distance D2 from top end guide surface 202*a* to nose guide surface 204*a*. These measurements are then used to determine the thickness of spacer 206, select the suitable spacer 206 and finally insert spacer 206 into the impact dot head. With the requirements of all these measurements, mass production is both difficult and costly.

There are also production problems inherent in the construction of the impact dot head disclosed in FIG. 3. This impact dot head requires an excessive amount of time to measure and select the thickness t of top end guide 302 and also a depth d of a groove 301*a* of nose 301 in which top end guide 302 is inserted. Therefore, mass-production of the impact dot head is hard to attain as well as being quite costly. The method of manufacturing nose 301 and top end guide 302 flush with each other by machining the surfaces causes wire guide hole 302*b* to be deformed. Thus, massproduction is again both difficult and costly.

It is, therefore, desirable to provide an impact dot head having the nose surface flush with the top end guide surface to improve the durability thereof, while at the same time permitting mass production of the impact dot head at a relatively low cost.

SUMMARY OF THE INVENTION

Generally speaking, in accordance with the present invention an impact dot matrix printer is provided. The impact dot head includes a plurality of printing wires for forming a desired dot pattern on a printing medium. A top end guide is provided formed with holes for slideably guiding the tips of the plurality of printing wires. A nose is fixed to the top end guide having its top surface confronting with printing medium. Finally, either the top end guide or the nose is deformed so the surface of the top end guide and the nose are fixed in essentially a flush relationship with respect to one another so that they rest on the same plane.

A method for manufacturing an impact dot head is also provided. The steps of manufacturing include inserting a top end guide having protrusions into a hole and grooves in the nose. Next, the top end guide and the nose are held by a jig so that the position of the surface of the top end guide and the nose are flush with respect to one another. The protrusions of the top end guide are deformed so that the surface for the top end guide is aligned on the same plane as the nose, and the nose is fixed to the top end guide.

In another method of manufacturing the impact dot head, protrusions of the top end guide having holes and protrusions of the nose having a hole are inserted into the holes of each other. The nose and the top end guide are held by a jig so that the positions of the surface of the top end guide and the nose are flush with respect to another. The protrusions of the top end guide and the nose are then deformed so that the surface of the top end guide are aligned on the same plane as the top end guide. Finally, the nose is fixed to the top end guide.

Accordingly, it is an object of the present invention to provide an improved impact dot head.

Another object of the invention is to provide an improved method of manufacturing an impact dot head.

A further object of the invention is to provide a method for manufacturing an impact dot head which does not require dimensional measurements in order to create a flush relationship between a top end guide and the nose of the impact dot head.

Still a further object of the invention is to provide an impact dot head with the top end guide and nose aligned on the same plane.

Yet still another object of the invention is to provide an impact dot head which can be mass produced at a relatively low cost.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 6*a*, 6*b* and 6*c* are a front elevational, fragmenting side elevational and fragmentary bottom plan views, respectively, of the top end guide of FIG. 4;

FIGS. 7*a*, 7*b* and 7*c* are fragmentary front elevational view, fragmenting side elevational and fragmenting bottom plan views respectively, of the nose of FIG. 4;

DETAILED DESCRIPTION OF THE PREFERRED EMBODIMENTS

Figure 1:
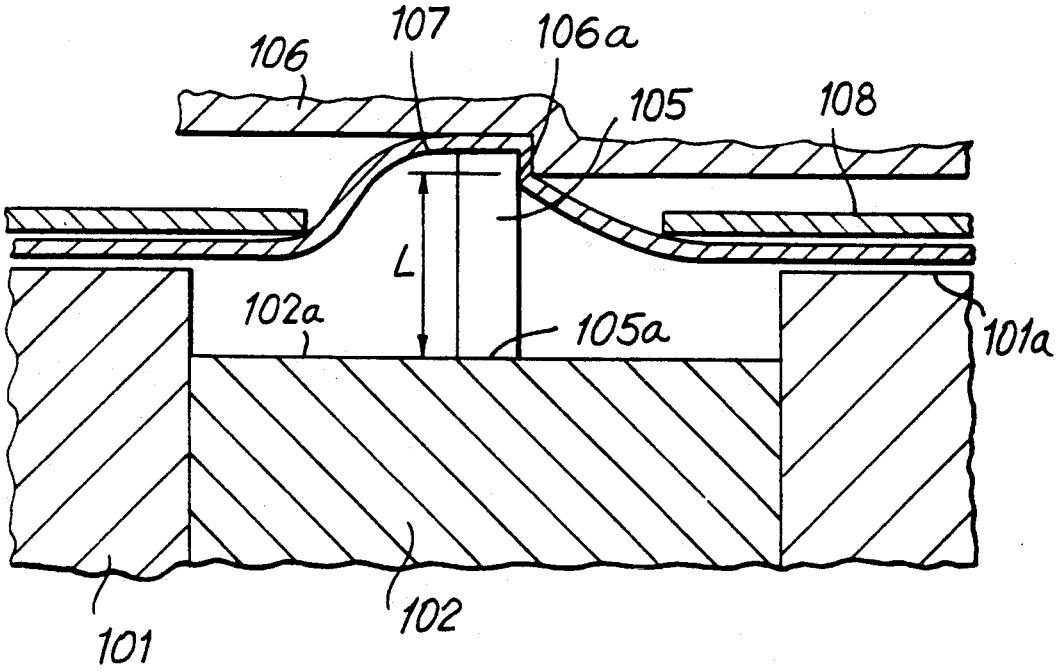
FIG. 1 PRIOR ART
FIG. 1 is a fragmentary sectional view of a prior art impact dot matrix printer illustrating the positional relationship between the nose and the top end guide of the impact dot head.
Figure 2:
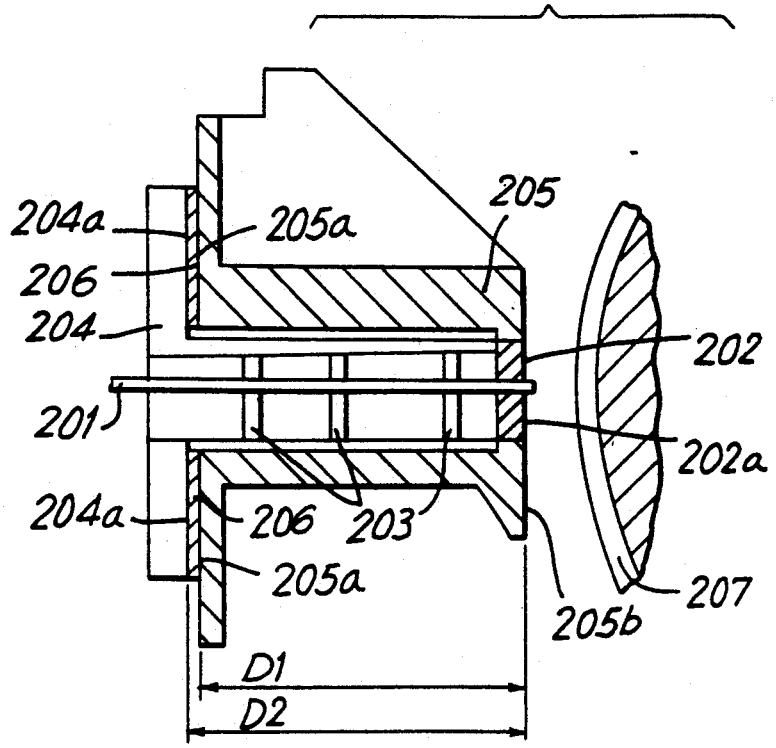
FIG. 2 PRIOR ART
FIG. 2 is a sectional view of the nose portion of another prior art impact dot head.
Figure 3:
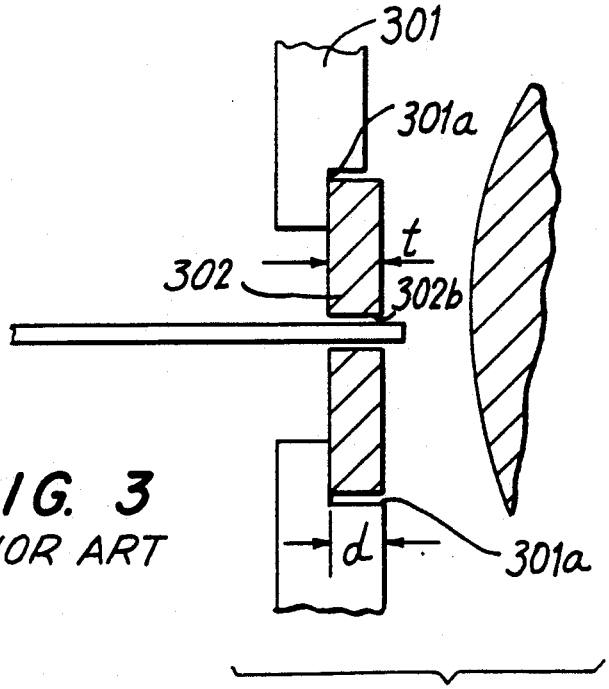
FIG. 3 PRIOR ART
FIG. 3 is a fragmentary sectional view of the nose portion of still another prior art impact dot head.
Figure 4:
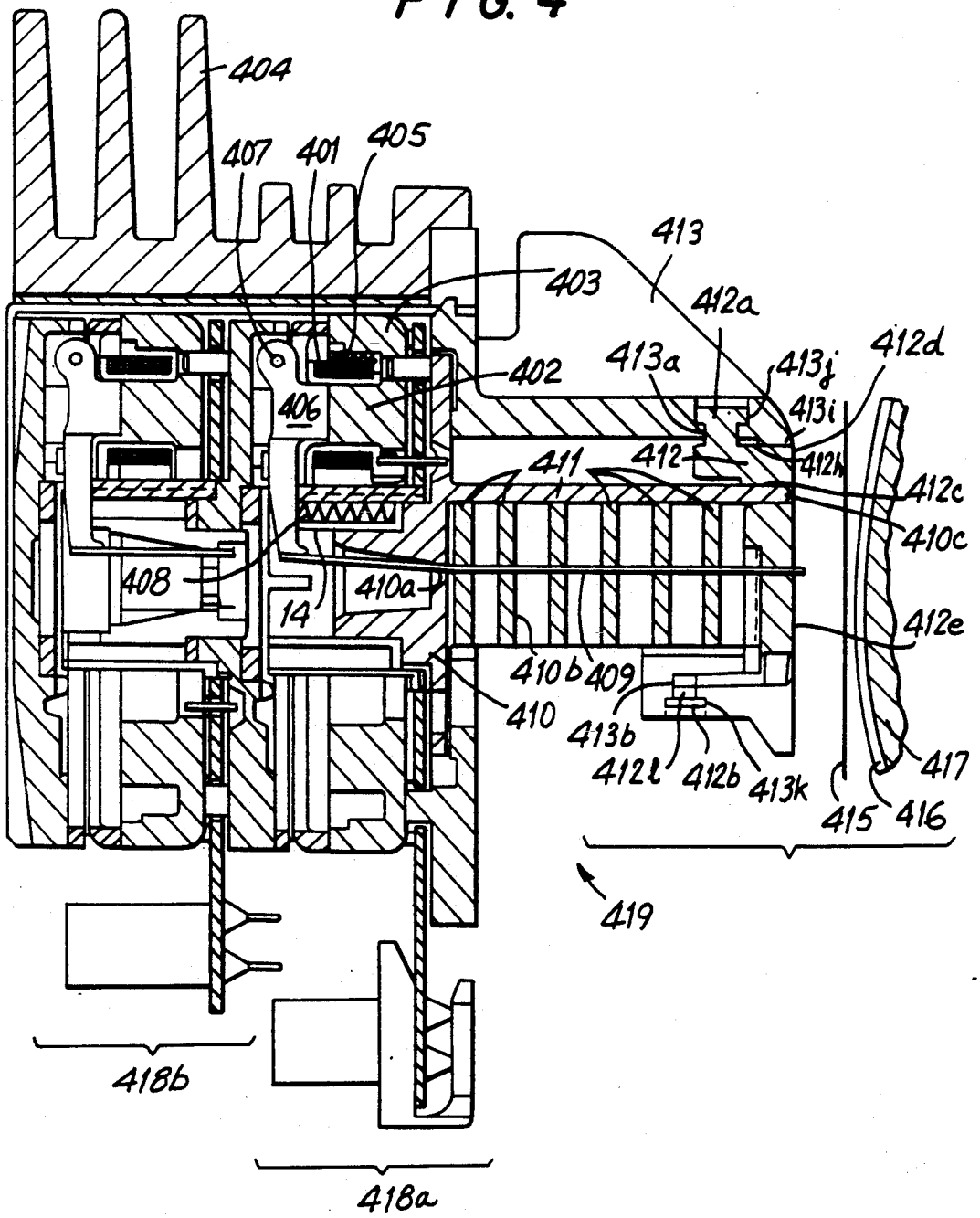
FIG. 4 is a sectional view of an impact dot head in accordance with the present invention.
Figure 5:
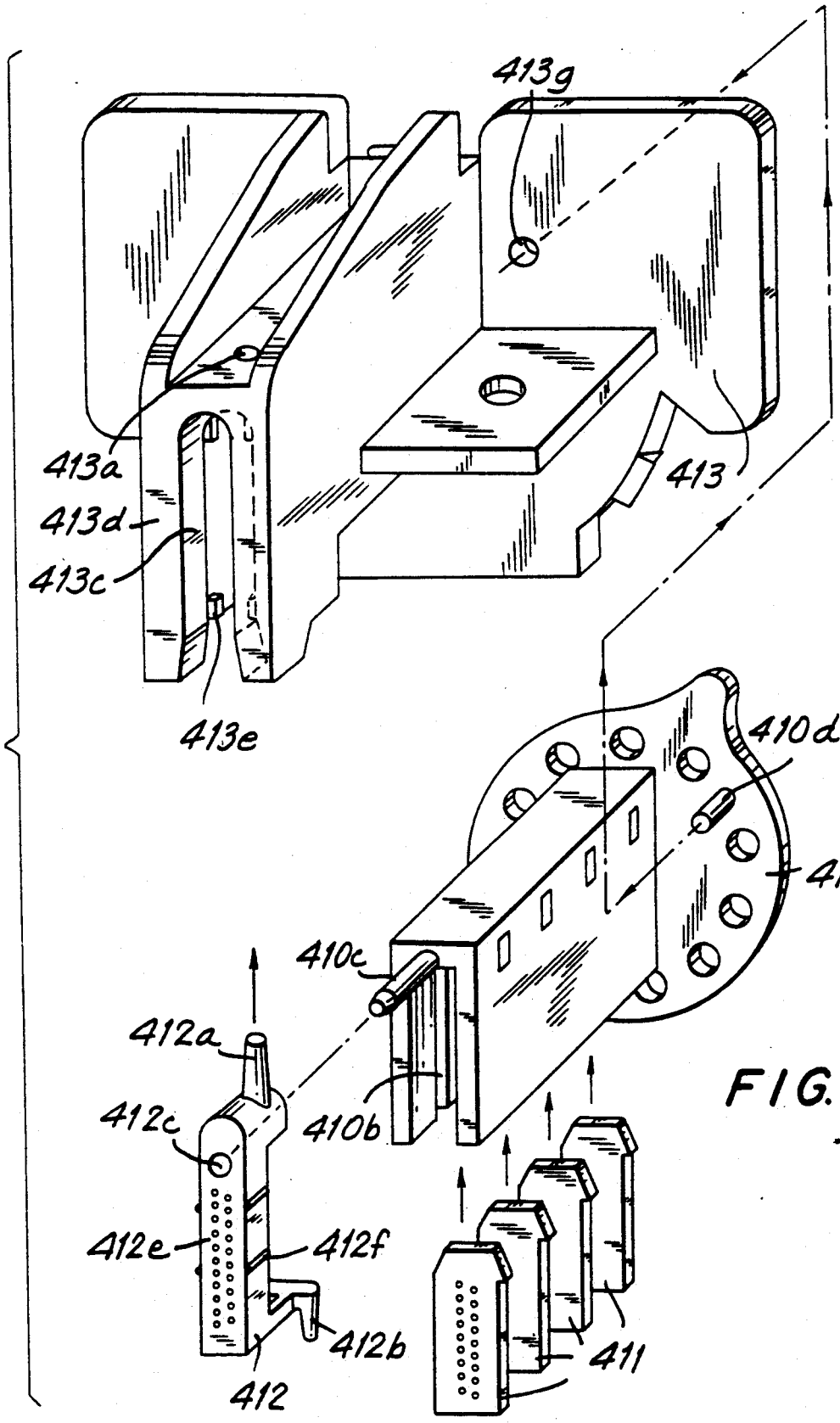
FIG. 5 an exploded perspective view of the nose portion of the impact dot head of FIG. 4.

An impact dot head 419 constructed in accordance with the invention is shown in FIGS. 4 and 5. Impact dot head 419 is provided with a driving unit composed of a front driving subunit 418*a* and a rear driving subunit 418*b* each driving subunit is constructed with the same mechanism. A core block 403 includes a plurality of cores 402. A driving coil 401 is inserted on each core 402 (only four cores 402 are shown in FIG. 4). The plurality of cores 402 are disposed along the periphery of the subdriving units 418*a* and 418*b*. Core block 403 makes contact with a radiation member 404 so that the two are bonded with one another by a heat-transferable resin 405. Heat-transferable resin 405 is also formed in core block 403. A movable piece 406 formed of a magnetic material is axially supported on a fulcrum shaft 407 to cooperate with core 402. Movable piece 406 is held in a standby state created by the force produced by a return spring 408.

A printing wire 409 is fixed to a tip of movable piece 406. Printing wire 409 is slidably retained by a guide hole bored in a guide holder 410, a plurality of middle guides 411 and a top end guide 412. Guide holder 410 is coupled to nose 413 by inserting a bottom protrusion 410*d* in a positioning hole 413*g* of nose 413, said nose being formed by aluminum die casting (FIG. 5). Guide holder 410 is also connected to a spring holder adapted to hold return springs 408 and formed with a protrusion for positioning core block 403.

The plurality of middle guides 411 are held in guide grooves 410*b* of guide holder 410. A top end protrusion 410 of guide holder 410 is inserted in a positioning hole 412*c* of top end guide 412. This configuration properly positions top end guide 412. In this arrangement, guide hole 410*a*, middle guides 411 and top end guide 412 are positioned with high accuracy. This arrangement provides a good sliding property for printing wires 409. Nose 413 is joined to radiation member 404 and includes a mounting member for a carriage (not shown).

When driving coil 401 is electrified to a predetermined level, movable piece 406 is shifted causing printing wire 409 to project outward as shown in FIG. 4. The outward projection causes printing wire 409 to impinge on a printing medium 416 held by a platen 417. Printing wire 409 forms dots on printing medium 416 through ink ribbon 415. Once printing wire 409 impinges upon printing medium 416, printing wire 409 is thrust back to its standby position by return spring 408.

Referring now to FIGS. 6*a*, 6*b* and 6*c*, top end guide 412 is disclosed. Top end guide 412 is formed of a thermoplastic material. Top end guide 412 is formed in a direction parallel to a surface 412*e*. Top end guide 412 is provided with several extending protrusions, namely, a protrusion 412*a* extending in an inserting direction A and protrusions 412*b* extending in a direction opposite to inserting direction A. Protrusion 412*b* extends in a direction parallel to surface 412*e*. A surface 412*g* (FIG. 8) is formed on the opposite side of the root of protrusion 412*a* for pushing by a jig during a welding process.

A positioning reference surface 412*h* is located adjacent protrusion 412*a*. The plurality of guide holes 412*i* are positioned based on the location of reference surface 412*h*. A holding member 412*j* for protrusions 412*b* is provided and hole 412*k* is bored through holding member 412*j* of top end guide 412. Hole 412*k* reduces the rigidity of holding member 412*j*, thereby providing a spring property to holding member 412*j*. Protrusion 412*b* is surrounded in part by a wall 412*l*. Tapered surfaces 412*d* are formed on both sides of surface 412*e*. Side surfaces are provided with minute protrusions 412*f*. The tapered surfaces allow for expansion and contraction during operation.

The configuration of nose 413 is shown FIGS. 7*a*, 7*b* and 7*c*. Top end surface 413*d* of nose 413 is formed with a U-shaped groove 413*c*. Top end guide 412 is inserted into U-shaped groove 413*c*. Surface 413*i* is coupled to reference surface 412*h* of top end guide 412. Nose 413 is provided with a hole 413*a* having a counterbore 413*j* positioned in inserting direction. A parallel with top end surface 413*d*. Additionally, nose 413 is provided with a U-shaped groove 413*b* having a counterbore 413*k* on the opposite side thereto. A length D from surface 413*i* to the bottom surface of U-shaped groove 413*b* is slightly longer than a length D' from reference surface 412*h* of top end guide 412 to the inner surface of holding member 412*j* at protrusions 412*b*. In this embodiment, D is longer than D' by 0–0.5 mm when measured over a range of points. A receiving member 413e is internally provided in U-shaped groove 413c. Receiving member 413e is set greater inside U-shaped member 413 than the fixing position of top end guide 412.

Figure 8:
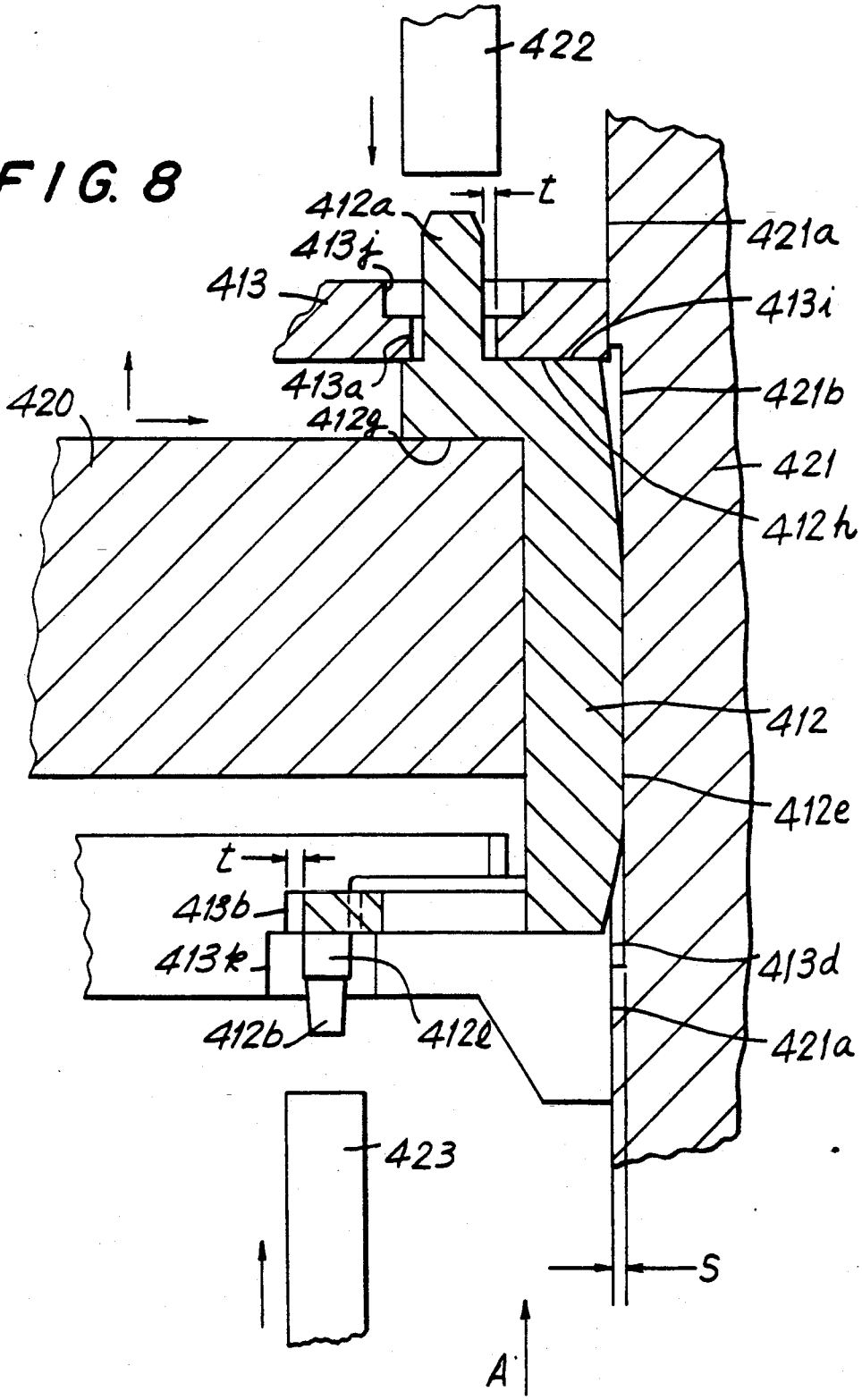
FIG. 8 is a fragmentary sectional view showing the method of manufacturing the impact dot head of FIG. 4.

Reference is now made to FIG. 8 which discloses a method for enabling top end surface 412e of top end guide 412 to be manufactured flush with top end surface 413d of nose 413. Top end guide 412 is inserted in U-shaped groove 413c of nose 413 in direction A. At this moment, minute protrusions 412f of top end guide 412 are crushed. In this manner, top end guide 412 can be set in nose 413 without slipping out (i.e., no backlash). Nose 413 is pushed against a positioning plate 421 by the application of a jig (not shown). At the same moment, top end guide 412 is pushed against positioning plate 421 by a presser jig 420. Top end surface 413d of nose 413 and top end surface 412e of top end guide 412 are thus positioned in a combined form.

Figure 9A:
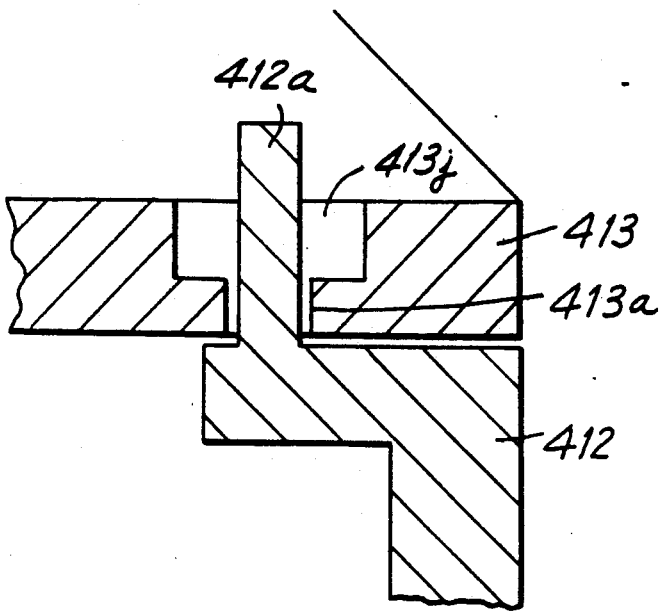
FIGS. 9*a* and 9*b* are fragmenting sectional views depicting the state of a protrusion in the top end guide of FIG. 4 before and after fusing, respectively.
Figure 9B:
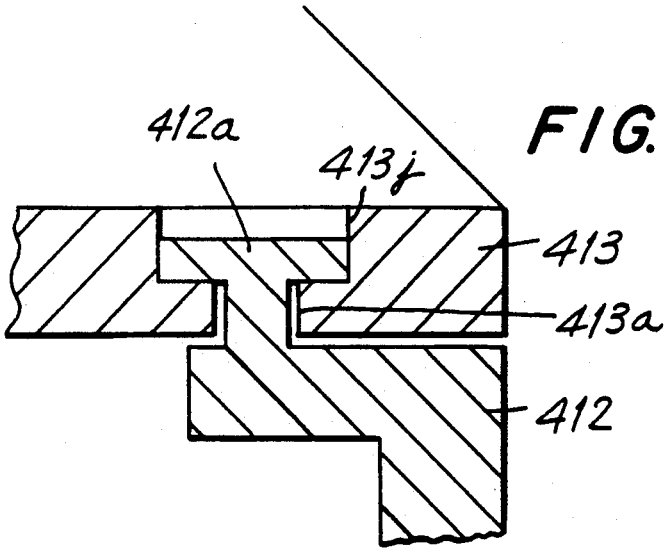

Presser jig 420 also directs surface 412g towards top end guide 412 so that guide reference surface 412h makes close contact with surface 413i of nose 413. When in this position, protrusion 412a of top end guide 412 is provided with pressure from a sonic sealing device 422 (e.g., a horn) to produce ultrasonic vibrations resulting in the fusion of protrusion 412a. Fixation of protrusion 412a may also be conducted by a thermo compression bonding method. Protrusion 412a is therefore fixed and fused to counterbore 413j of hole 413a of nose 413. FIGS. 9(*a*) and 9(*b*) depict the states of protrusion 412a before and after fusing.

Figure 10A:
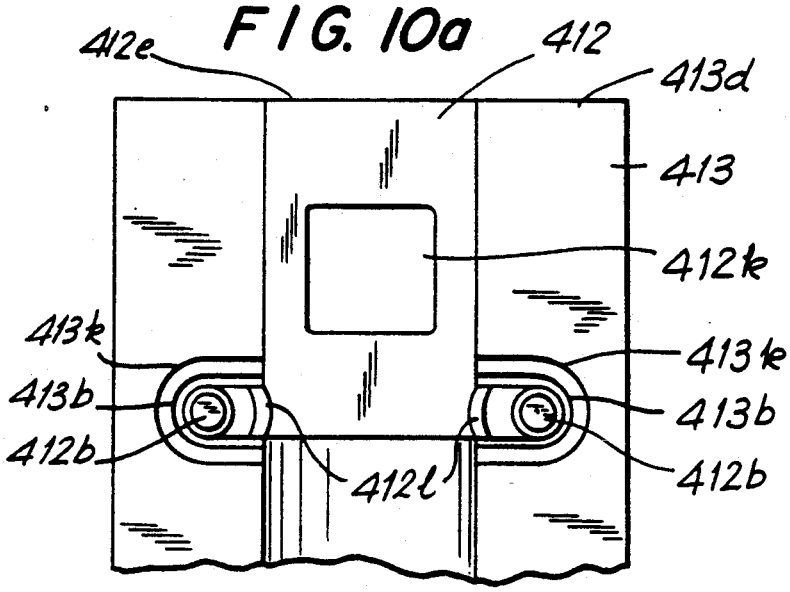
FIGS. 10*a* and 10*b* are fragmentary sectional views of a protrusion of the top end guide of FIG. 4 before and after fusing, respectively.
Figure 10B:
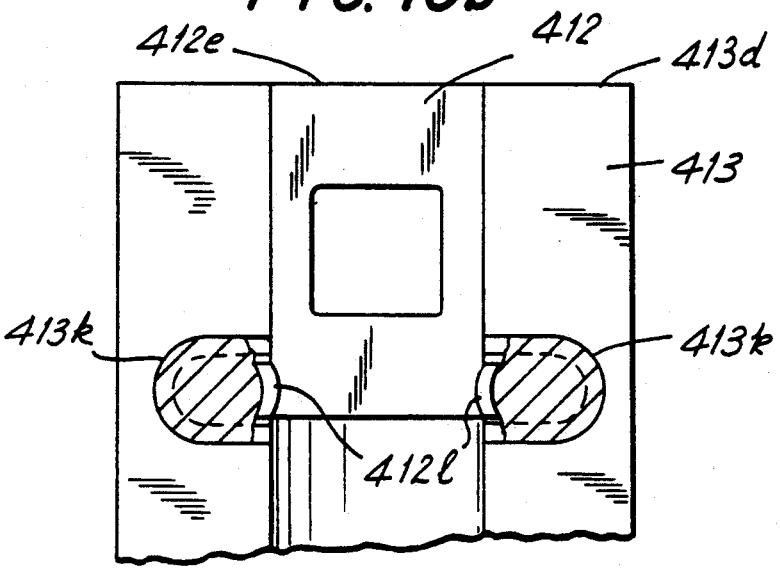

At the moment sonic sealing device 422 is actuated, presser jig 420 is also pushing surface 412g, and thereby surface 412g receives the pressure of sonic sealing device 422. Accordingly, fusing is surely performed and no deformation is caused to the other portions of impact dot head 419. Next, the two protrusions 412b of top end guide 412 are similarly fused while being pressurized by a sonic sealing device 423 (e.g., a horn) for causing ultrasonic vibrations. Protrusions 412b are fused and charged into a counterbore 413k of groove 413b of nose 413. At this time, charging occurs without any outflow from counterbore 413k because of an existence of the wall 412l of top end guide 412. FIG. 10 illustrates states of protrusions 412b before and after fusing.

Referring again to FIGS. 6 and 7, a dimension D from surface 413i of nose 413 to bottom surface of groove 413b is greater than a dimension D' from reference surface 412h of top end guide 412 to the inner surface of holding member 412j at protrusions 412b. Holding member 412j of top end guide 412 is provided with a spring like property. Hence, protrusions 412b are invariably pressed against the bottom surface of groove 413b of nose 413 so that protrusions 412b are not afloat. As a result, the positions of protrusions do not change after being charged.

When the temperature of top end guide 412 returns to normal temperature after causing a thermal expansion and a thermal deformation of the material during the fusing process, top end guide 412 varies in dimensions. Therefore, steps S shown in FIG. 8 are provided on a joint surface 421a of a presser plate 421 to nose 413 and on a joint surface 421b to top end guide 412. After the fixation and thermal contraction, nose 413 and top end guide 412 are positioned on essentially the same plane. In this embodiment, step S is set in a range from 0 to 0.1 mm. Gaps t are formed between hole 413a of nose 413 and protrusion 412a of top end guide 412 and between groove 413b of nose 413 and protrusion 412b of top end guide 412. Gaps t enable top end guide 412 to make a small amount of movement prior to being fixed. Hence, top end guide 412 can be positioned without being restricted by hole 413a and grooves 413b.

By the method set forth above, the steps between top end surface 413d of nose 413 and top end surface 412e of top end guide 412 can be set to ±0.03 mm. Therefore, this step is stably minimized with a high accuracy. When this step is set at ±0.03 mm, the rate at which the printing wire is broken when the printing wire is caught by a stepped portion of the printing medium is decreased to a 1/10 of that of the prior art. In the present invention, the possibility the wires being broken in practical use is almost non-existent. Even when top end surface 412e of top end guide 412 projects slightly from nose surface 413d, the ribbon can be smoothly set and removed with respect to the tapered surfaces 412d.

During the manufacturing of this embodiment, a fusing time is set between 0.1 sec and 2 sec. A pressurizinq force is set between 0.5 kgf and 10 kgf, whereby manufacturing can be stably done in a remarkably short time. In accordance with the present invention, the need for dimensional measurement and selection is absolutely eliminated. Hence, a large quantity of products can be manufactured in a short period of time, thereby allowing excellent mass production and a great reduction in manufacturing costs.

Figure 11A:
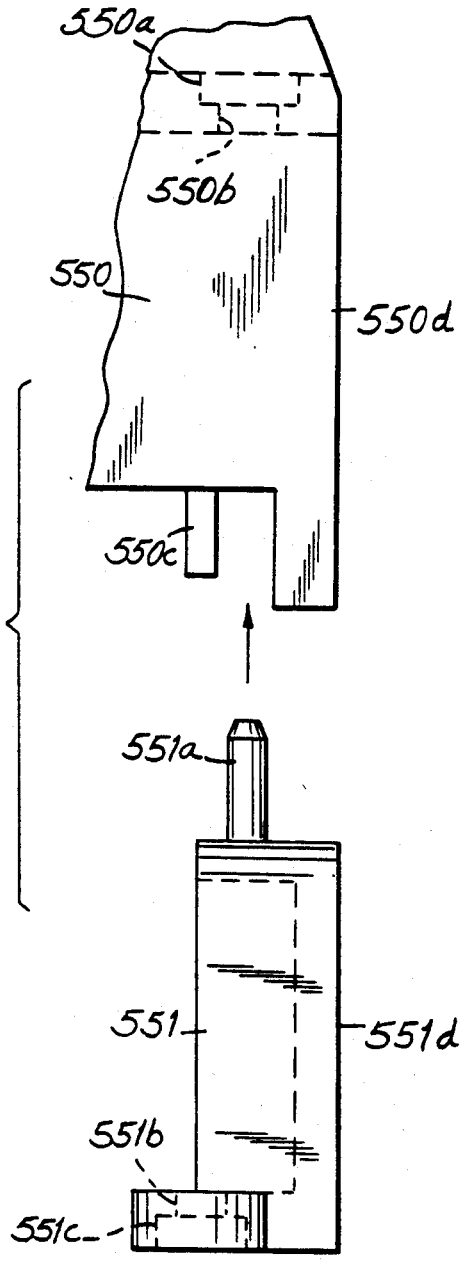
FIGS. 11*a* and 11*b* are side elevational views of an impact dot head in accordance with another embodiment of the present invention.
Figure 11B:
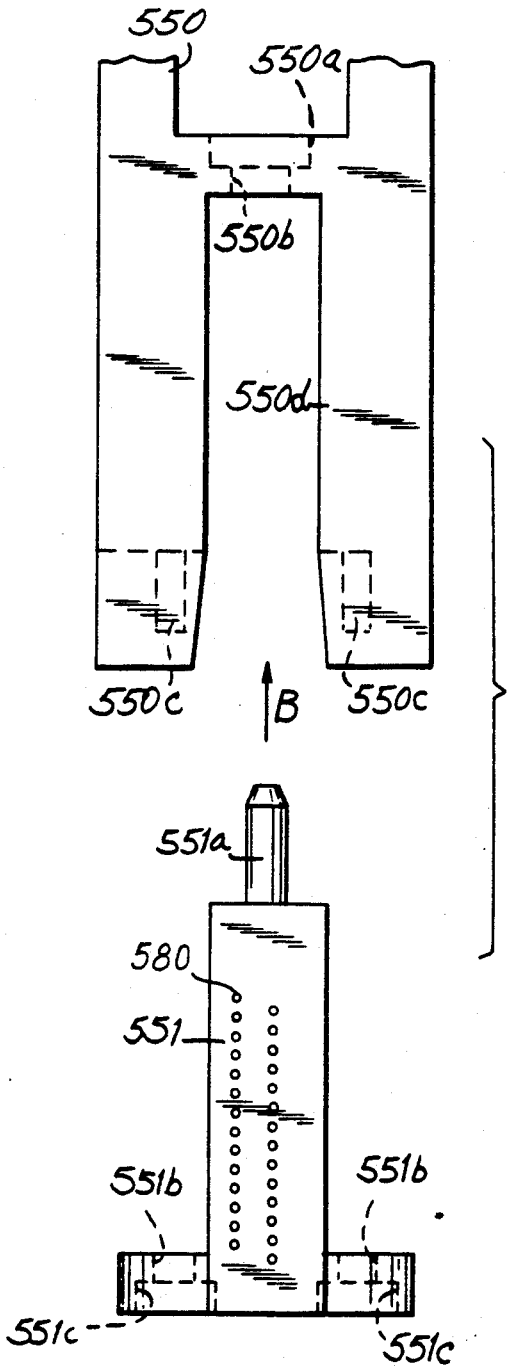

Reference is now made to FIGS. 11a and 11b which show an alternative embodiment of the present invention. A nose 550 is constructed with a thermoplastic material. Nose 550 includes a hole 550b having a counterbore 550a in an inserting direction B. Hole 550b is positioned in parallel with a top end surface 550d. Nose 550 is further provided with two protrusions 550c formed on opposite sides of nose 550. A plastic top end guide 551 has protrusions 551a in inserting direction B in parallel with a top end surface 551d. Top end guide 551 also includes holes 551b having counterbores 551c formed on opposite sides with respect to one another. In addition, top end guide 551 is provided with a plurality of guide holes 580.

The manufacturing method of manufacturing top end surface 550d of nose 550 flush with top end guide surface 551d is the same as that disclosed with the first embodiment. Protrusions 550c of nose 550 are fused and charged in counterbores 551c of top end guide 551. Protrusions 551a of top end guide 551 is fused and charged in counterbore 550a of nose 550. Protrusions 551a are fixed to be flush with each other so that they rest on the same plane. As in the first embodiment, mass-production is obtained at low cost while providing the nose surface and top end guide surface on essentially the same plane with high accuracy.

Accordingly, an impact dot head is provided capable of improving the durability of the device. In the impact dot head, the nose surface is made essentially flush with the top end guide surface without the need for dimensional measurements. The nose is made flush by sonicly compressing the protrusions inserted into the nose and thereby obtaining a flush relation (i.e., same plane relation) with high accuracy. Further, the impact dot head can be mass produced at a relatively low cost.

It will thus be seen that the objects set forth above among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also the be understood that the following claims are intended to cover all of the generic and specific features of the invention herein described and all statements of the scope of the invention which, as a matter of language, might be said to fall therebetween.

What is claimed is:

1. An impact dot head for a printer capable of imprinting on a printing medium, comprising:

a plurality of printing wires for forming desired dot patterns on a printing medium;

top end guide means for slidably guiding the tips of the printing wires and having an end surface facing the printing medium, the top end guide means including at least one laterally extending protrusion; and a nose joined to the top end guide means and having an end surface facing the printing medium, the nose including at least one aperture for receiving the protrusion, said protrusion of said top end guide means being deformed to interlock in the aperture of the nose and to effect the joining thereof so that at least portions of the respective end surfaces of the top guide means and the nose are fixed in a predetermined relationship with respect to one another;

wherein said aperture includes a recess at its outer end extending beyond the width of the aperture for receiving the deformed portion of the corresponding protrusion of the top end guide means, so that the protrusion integrally fits in the recess.

2. The impact dot head of claim 1, wherein the top end guide means is formed with holes for slidably guiding the tips of the printing wires.

3. The impact dot head of claim 1, wherein a projection at one end of the top end guide means is fixed to a reference surface.

4. The impact dot head of claim 1, wherein the top end guide means is provided with an end surface having tapered side portions and an essentially flat central portion, said tapered portions extending from said central portion in a direction away from the printing medium.

5. The impact dot head of claim 1, wherein at least one portion of said respective end surface of said top end guide means and said nose are in an essentially flush relationship.

6. The impact dot head of claim 1, wherein the top end guide means is formed from a thermoplastic material.

7. An impact dot head for a printer capable of imprinting on a printing medium, comprising:

a plurality of printing wires for forming desired dot patterns on a printing medium;

a nose having an end surface facing the printing medium and at least one laterally extending protrusion at one side thereto; and top end guide means for slidably guiding the tips of the printing wires and having an end surface facing the printing medium, said nose being joined to said top end guide means, the top end guide means including an aperture therethrough for receiving said at least one protrusion of said nose;

wherein a portion of one of the top end guide means and the nose are independently deformed after they are joined to effect the fixing thereof to one another so that at least portions of the respective end surfaces of the top end guide means and the nose are fixed in a predetermined relationship with respect to one another.

8. The impact dot head of claim 7, wherein said at least one protrusion is deformed and is fixedly interlocked in the corresponding aperture of the top end guide means.

9. An impact dot head for a printer capable of imprinting on a printing medium, comprising:

a plurality of printing wires for forming desired dot patterns on a printing medium;

a nose including an end surface facing the printing medium, the nose further including at least one laterally extending protrusion at one side thereof; and top end guide means for slidably guiding the tips of the printing wires and having an end surface facing the printing medium, said nose being joined to said top end guide means, the top end guide means including at least one aperture for receiving the protrusion of said nose, said protrusion of said nose being deformed to fixedly interlock in the corresponding aperture of the top end guide means and to effect the joining thereof so that at least portions of the respective end surfaces of the top end guide means and the nose are fixed in a predetermined relationship with respect to one another;

wherein the at least one aperture includes a recess at the outer end thereof extending beyond the width of the aperture for receiving the deformed portion of the corresponding protrusion, so that the deformed protrusion fits in the recess.

10. A method of manufacturing an impact dot head, comprising the steps of:

inserting a top end guide having at least one laterally extending protrusion into at least one aperture of a nose so that said protrusion extends through and projects out of the outer side of the aperture in the nose;

holding the nose and the top end guide by a jig so that the positions of at least portions of the respective end surfaces of the top end guide and the nose are in predetermined relation flush with respect to one another; and deforming the protrusion of the top end guide to interlock the nose and top end guide, with the end surfaces of the top end guide and nose being essentially aligned in said predetermined relation.

11. The method of claim 10, further including crushing a plurality of protrusions fixed to the top end guide between the top end guide and nose upon their assembly to lock the top end guide to the nose.

12. The method of claim 10, pushing said top end guide in the direction of one end thereof having at least one of said projections and a reference surface for engagement against the nose and pushing the nose against a positioning plate simultaneously.

13. The method of claim 12, wherein the surface of said positioning plate facing the nose and top end guide as formed with a recess facing said top end guide to permit thermal deformation of said top end guide.

14. The method of claim 10, wherein said top end guide is formed of a thermoplastic material.

15. The method of claim 10, wherein top end guide is inserted in an essentially flush relation to the nose.

16. The method of claim 10, wherein the protrusions are deformed to substantially fill a recess adjacent the outer end of said aperture of the top end guide.

17. The method of claim 10, wherein the protrusions are deformed by a sonic sealing device.

18. The method of claim 10, wherein the protrusions are deformed by a thermal compression bonding method.

19. A method of manufacturing an impact dot head, comprising the steps of:

inserting a top end guide having at least one aperture into a nose having at least one protrusion so that said protrusion of said nose extends through and projects out of the outer side of the aperture in the top end guide;

holding the nose and the top end guide by a jig so that the positions of at least portions of the respective end surfaces of the top end guide and the nose are in a predetermined relation with respect to one another; and deforming the protrusion of the nose so that at least a portion of the end surfaces of the top end guide and nose are essentially aligned in predetermined relation to interlock the nose with top end guide.

20. The method of claim 19, wherein the nose is formed of a thermoplastic material.

21. The method of claim 19, wherein the protrusions are deformed by a sonic sealing device.

22. The method of claim 19, wherein the protrusions are deformed by a thermal compression bonding method.

23. The method of claim 19, wherein the protrusions are deformed to substantially fill a recess adjacent the outer end of nose aperture of the top end guide.

* * * * *